US005845795A

United States Patent [19]

Mulholland

[11] Patent Number: 5,845,795

[45] Date of Patent: Dec. 8, 1998

[54] STORAGE RACK AND BRACKET FOR SAME

[75] Inventor: Anthony G. Mulholland, Mississauga, Canada

[73] Assignee: Econo-Rack Storage Equipment Limited, Mississauga, Canada

[21] Appl. No.: 646,933

[22] Filed: May 8, 1996

[51] Int. Cl.[6] ..... A47F 5/00

[52] U.S. Cl. ..... 211/192; 248/221.12

[58] Field of Search ..... 211/192, 191; 248/221.12, 222.12, 223.13; 403/315, 316, 393

[56] References Cited

U.S. PATENT DOCUMENTS

| | | | |
|---|---|---|---|
| 3,042,221 | 7/1962 | Rasmussen | 211/192 X |
| 3,070,237 | 12/1962 | Fullerton et al. | 211/192 |
| 3,273,720 | 9/1966 | Seiz | 211/192 |
| 3,351,212 | 11/1967 | McConnell | 211/192 |
| 3,392,848 | 7/1968 | McConnell et al. | 211/192 |
| 3,545,626 | 12/1970 | Seiz | 211/192 |
| 3,612,290 | 10/1971 | Evans | 211/192 |
| 3,647,079 | 3/1972 | Ohlin | 211/192 |
| 4,496,061 | 1/1985 | Highsmith | 211/191 |
| 4,955,743 | 9/1990 | King | 211/192 X |
| 5,350,074 | 9/1994 | Rosenband | 211/192 |

FOREIGN PATENT DOCUMENTS

| | | | |
|---|---|---|---|
| 402883 | 5/1970 | Australia | 211/191 |

*Primary Examiner*—Robert W. Gibson, Jr.
*Attorney, Agent, or Firm*—Baker & Daniels

[57] ABSTRACT

A storage rack includes an upright frame structure having a plurality of upright axial load carrying members at its corners. A plurality of pairs of laterally spaced, generally parallel support beams extend across pairs of the upright axial members at different elevations to support pallets and the like. Brackets interconnect the support beams and the upright axial members. Each bracket includes at least one axially adjustable lug which is accommodated by a primary hole in one of the upright axial members. The primary holes are shaped so that the lugs self-plumb when accommodated by the holes. The lugs are axially adjustable to allow for a flush connection between the brackets and the upright axial members. The lugs can also be removed from the brackets allowing the brackets to be used in structural storage racks and roll-form storage racks. The lugs can also be positioned on the bracket to allow the bracket to be attached either to a structural storage rack or a roll-form storage rack.

15 Claims, 8 Drawing Sheets

STORAGE RACK AND BRACKET FOR SAME

FIELD OF THE INVENTION

The present invention relates to storage systems and in particular to a storage rack to support pallets or the like and a bracket for the same.

BACKGROUND OF THE INVENTION

Storage racks for supporting pallets or the like are well known in the art and various designs have been considered. Conventional storage racks typically include an upright frame structure having pairs of generally parallel, laterally spaced support beams at different elevations. Pallets to be supported on the storage racks are placed on the storage racks by lift trucks or other suitable devices in a manner so that the pallets are supported at opposite ends by the two support beams in a pair.

Conventional storage racks are almost always shipped unassembled and are then assembled at the warehouse site. The method by which the support beams are connected to the upright frame structure has been the focus of design since the connection between the support beams and the upright frame structure determines the axial strength of the upright frame structure, the interchangeability of storage rack components with other storage racks as well as the moment capacity of the connection.

Structural storage racks make use of hot-rolled structural steel C-channel members as the upright axial load carrying members in the upright frame structure. These C-channel members typically have two columns of holes formed therein along their length and spaced 2 or 4 inches apart. Brackets which support the ends of the support beams also have holes formed in them which align with the holes in the C-channel members. Bolts pass through the holes in the C-channel members and the brackets to secure the support beams to the upright frame structure. Unfortunately a problem exists in that assembly of structural storage racks of this nature at a warehouse site is difficult due to the fact that an individual must support each end of the support beam, align the holes in the brackets and the C-channel members and at the same time, push bolts through the aligned holes.

Roll-form storage racks also have upright members to which the brackets supporting the ends of the support beams are attached. Unlike the C-channel members referred to above, the upright members have self-plumbing teardrop-shaped holes formed therein along their length and spaced apart by about 2 inches. Studs are rivetted to the brackets and are received by the teardrop-shaped holes. Once the studs are inserted into the holes, the support beam is released so that the studs self-plumb and seat at the narrower bottom portion of the holes. Although this design facilitates assembly of the storage rack problems exist. Since the studs are permanently fastened to the brackets, their length must be such to allow for tolerances in upright member thickness. Thus, the length of the stud must account for the thickest possible upright member and therefore, in the case of the normal thickness upright members, the brackets and upright members do not sit flush. Also, since the studs are permanently fastened to the brackets, brackets made for roll-form storage racks cannot be used with structural storage racks.

It is therefore an object of the present invention to provide a novel storage rack to support pallets or the like and a bracket for the same which obviates or mitigates at least one of the above-identified disadvantages.

SUMMARY OF THE INVENTION

According to one aspect of the present invention there is provided a storage rack to support pallets or the like comprising:

an upright frame structure having a plurality of upright axial members; and at least two laterally spaced, generally parallel support beams extending between pairs of said upright members and connected thereto by way of brackets, one of said upright members and brackets having primary holes formed therein and the other of said upright members and brackets having projections thereon to be accommodated by said primary holes, said primary holes being shaped so that said projections self-plumb when accommodated by said primary holes, said projections being axially adjustable.

According to another aspect of the present invention there is provided a storage rack to support pallets or the like comprising:

an upright frame structure having a plurality of upright axial members at the corners thereof;

a plurality of pairs of laterally spaced, generally parallel support beams at different elevations extending between pairs of said upright members; and a plurality of brackets, each of said brackets interconnecting an end of one of said support beams to one of said upright members, each of said brackets including at least one axially adjustable projection thereon to be accommodated by primary holes formed in said upright member, said primary holes being shaped so that said projections self-plumb when accommodated by said primary holes.

In a preferred embodiment, the projections are easily removable and are in the form of lugs attached to the brackets. In this embodiment, it is preferred that the lugs include means to inhibit rotation thereof when the lugs are being axially adjusted. The means to inhibit rotation of the lugs may be in the form of a plurality of circumferentially spaced wedges on the lugs or other suitable formations formed on the lugs or brackets.

It is also preferred that the upright members and the brackets further include secondary holes which align when the lugs are accommodated by the primary holes, the secondary holes for receiving secondary retaining means. In one form, the secondary retaining means may be in the form of retaining pins carried by the brackets. Alternatively, the secondary retaining means may be in the form of nuts and bolts passing through the secondary holes provided in the upright members and brackets.

According to still yet another aspect of the present invention there is provided a bracket to interconnect a generally horizontal support beam and an upright frame member, said bracket including a pair of plates arranged generally at right angles, one of said plates to be attached to said support beam, another of said plates carrying at least one axially adjustable projection to be accommodated in a complimentary formation formed in said upright member and configured to allow said projection to self-plumb.

The present invention provides advantages in that the storage rack can be assembled with relative ease and without the need for tools due to the configuration of the primary holes and the lugs. Also, since the lugs are axially adjustable a flush connection between the brackets and the upright members of the frame structure can be achieved. The secondary holes which align when the lugs are accommodated in the primary holes allow for additional structural security between the brackets and the upright members if desired. Also, because the lugs are removable, the brackets can be used in a structural storage rack as well as in a roll-form storage rack.

BRIEF DESCRIPTION OF THE DRAWINGS

Embodiments of the present invention will now be described by way of example only with reference to the accompanying drawings in which.

DESCRIPTION OF THE PREFERRED EMBODIMENTS

Figure 1:
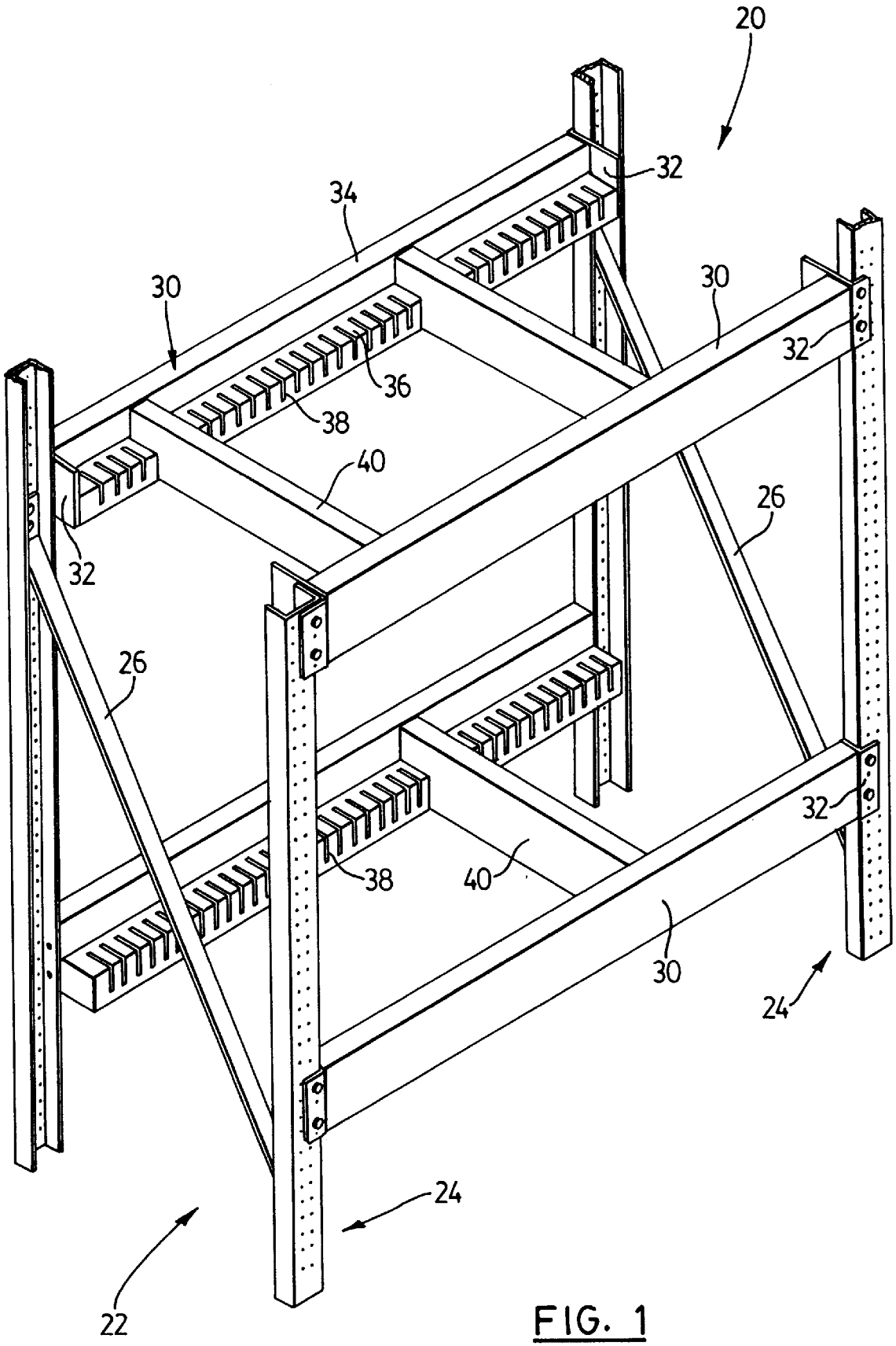
FIG. 1 is a perspective view of a storage rack to support pallets or the like in accordance with the present invention.

Referring now to FIG. 1, a storage rack for supporting pallets or the like is shown and is generally indicated to by reference numeral 20. The storage rack 20 includes an upright frame structure 22 having upright axial load carrying members 24 at its corners. Bracing members 26 span the upright members 24 and are secured to the upright members by suitable fasteners (not shown). Pairs of generally parallel, laterally spaced support beams 30 span pairs of upright members 24 at different elevations. The support beams 30 are secured to the upright members 24 by way of bracket 32.

The support beams 30 are preferably generally L-shaped to form steps defining upper and lower support surfaces 34 and 36 respectively. The upper support surfaces 34 are intended to support pallets and the like placed on the storage rack 20. A row of laterally spaced slots 38 are formed in the lower support surface 36 of each support beam 30 and accommodate formations on transverse safety bars 40. The safety bars 40 span the support beams 30 of each pair at laterally spaced locations to provide additional supporting surfaces for pallets and the like supported on the storage rack 20. It is preferred that the safety bars are of the form described in Applicant's co-pending application filed on Jun. 7, 1995 and issued Ser. No. 08/475,601, the content of which is incorporated herein by reference.

Figure 2:
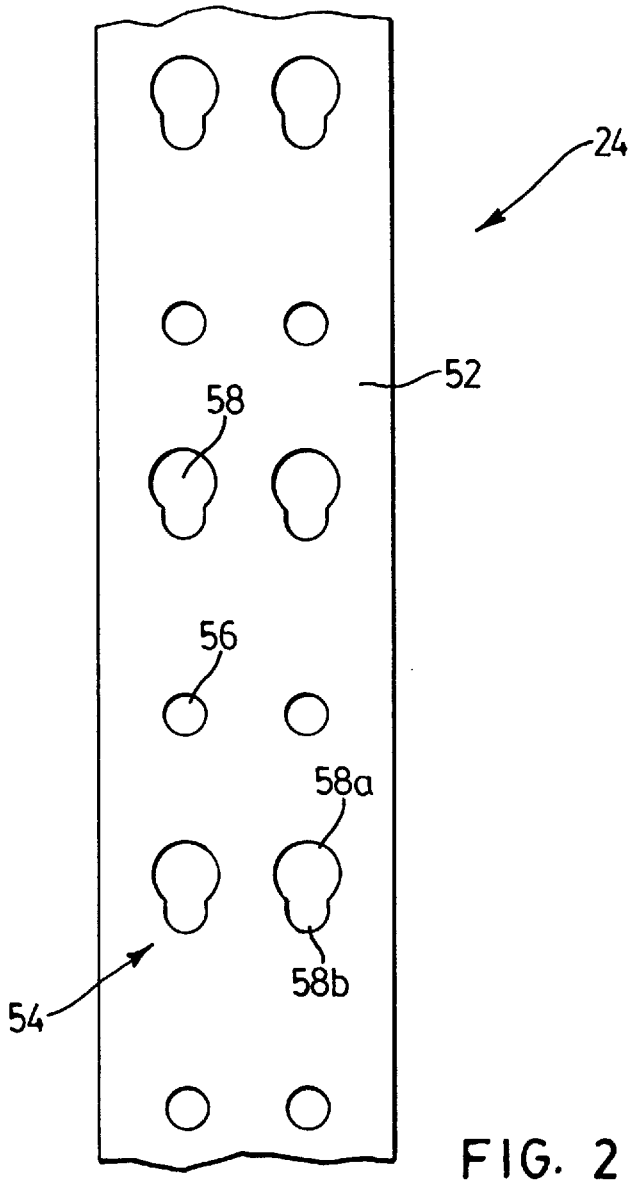
FIG. 2 is a front elevational view of a portion of a C-channel member forming part of the storage rack of FIG. 1.
Figure 3:
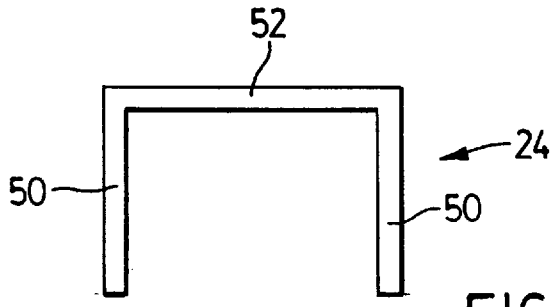
FIG. 3 is a top plan view of the C-channel member of FIG. 2.

Turning now to FIGS. 2 and 3, a portion of one of the upright members 24 is better illustrated. As can be seen, the upright member 24 is in the form of a C-channel member having a pair of limbs 50 bridged by a bight 52. Two columns of apertures 54 are formed in the bight 52. The apertures in the two columns are aligned and are located at vertically spaced locations along the length of the upright member 24. The apertures in the two columns are spaced apart by about two inch centers. The configuration of the apertures in each column alternates between circular holes 56 and teardrop-shaped holes 58. The teardrop-shaped holes 58 have larger diameter portions 58*a* and smaller diameter portions 58*b*. Adjacent holes in the two columns have the same configuration.

Figure 4:
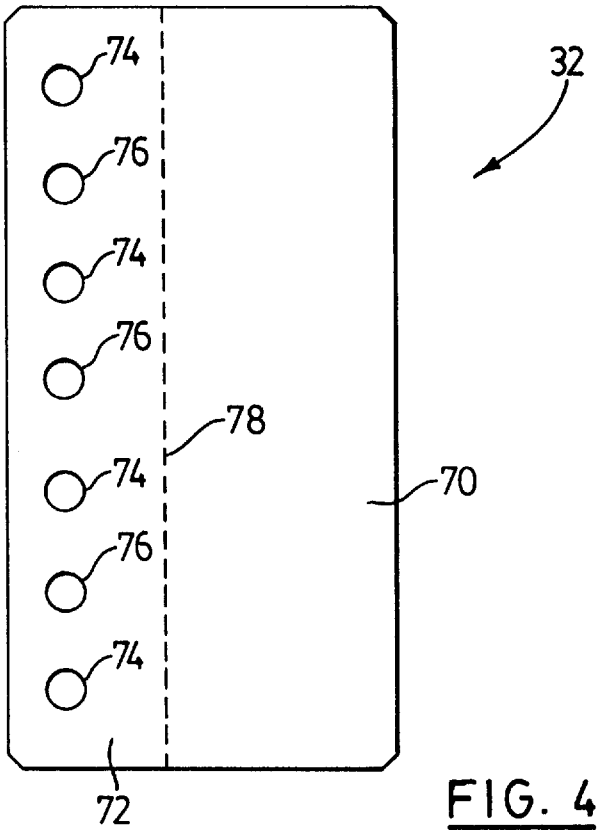
FIG. 4 is a front elevational view of a bracket in an unfolded condition forming part of the storage rack of FIG. 1.
Figure 5:
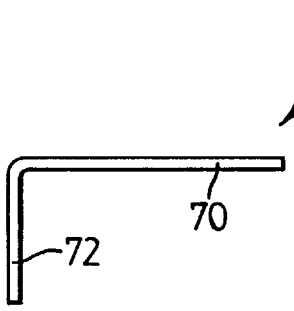
FIG. 5 is a top plan view of the bracket of FIG. 4 in a folded condition.

FIGS. 4 and 5 better illustrate one of the bracket 32. As can be seen, each bracket assemblies 32 includes an angle bracket 68 having a pair of face plates 70 and 72 arranged at generally right angles. Face plate 72 has two columns of apertures 74 and 76 formed in it. The apertures in the two columns are slightly offset. The apertures 74 and 76 are formed in face plate 72 while the bracket 68 is in an unfolded condition as shown in FIG. 4. The bracket 68 is then bent along bend line 78 to orient the face plates 70 and 72 at generally right angles.

Figure 6:
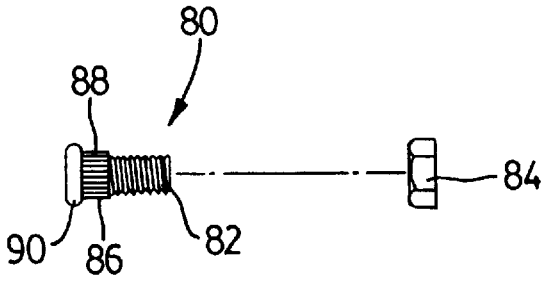
FIG. 6 is a top plan view of a lug forming part of the storage rack of FIG. 1.
Figure 7:
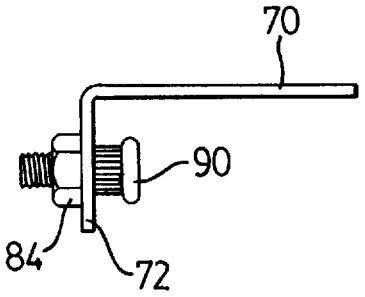
FIG. 7 is a top plan view of the lug of FIG. 6 secured to the bracket of FIG. 5.

Referring now to FIGS. 6 and 7, a projection 80 in the form of a lug removably attached to a bracket 68 is shown. The lug 80 includes a threaded shaft 82. A nut 84 threadably engages the shaft 82 to secure the lug to the bracket 68. At the end of the shaft 82 is an intermediate body portion 86 upon which a plurality of circumferentially spaced axial wedges 88 are formed. The wedges 88 engage the face plate 72 to inhibit the lug 80 from rotating when the nut 84 is tightened to adjust axially the length of the lug that extends outwardly from the face plate 72. A cap 90 is formed at the end of the lug 80 and is dimensioned so that it only fits through the larger diameter portion 58*a* of a teardrop-shaped hole 58. The intermediate body portion 86 of the lug is dimensioned to be accommodated by the smaller diameter portion 58*b* of a teardrop-shaped hole.

Figure 8A:
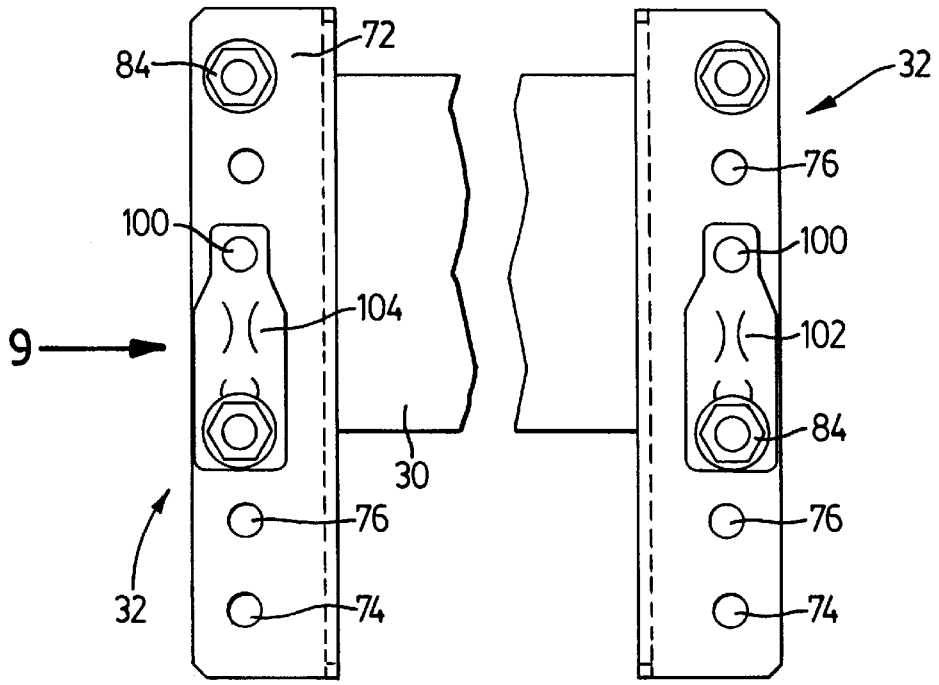
FIG. 8*a* is a front elevational view of a support beam and a pair of brackets with the lugs positioned for attachment of the brackets to the structural storage rack of FIG. 1.
Figure 9:
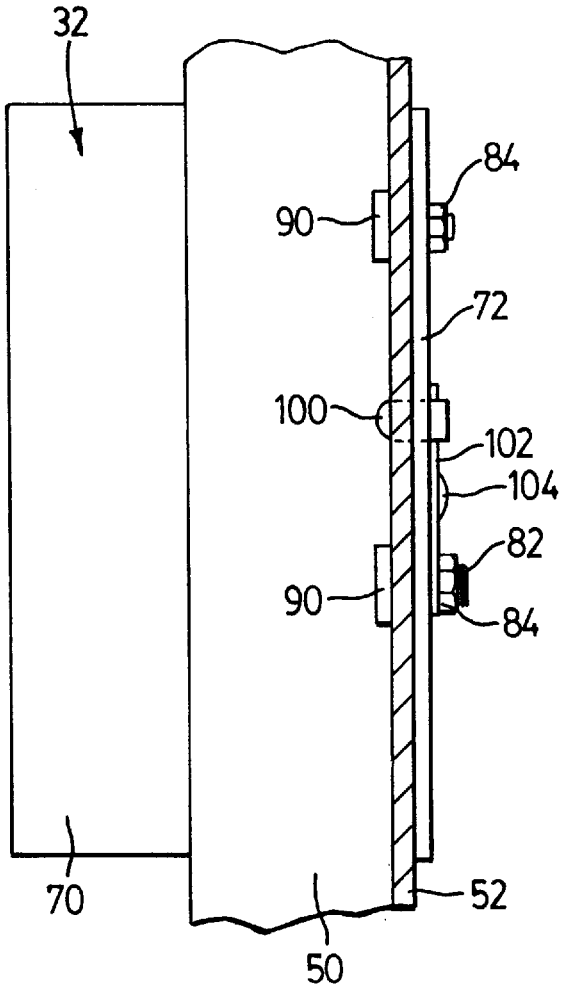
FIG. 9 is a side elevational view of FIG. 8*a* taken in the direction of arrow 9 with the brackets attached to a structural storage rack.

The lugs 80 are positioned on the brackets 32 depending on the type of storage rack to which the bracket assemblies 32 are to be attached. FIGS. 8*a* and 9 show the lugs 80 positioned on the brackets 32 in a manner to facilitate attachment of the brackets 32 and support beam 30 to a structural storage rack of the type illustrated in FIG. 1. As can be seen, the shafts 82 of the lugs are inserted into the apertures 74 and are retained on the brackets by the nuts 84. The lugs 80 are positioned so that they are spaced by approximately four inch centers allowing the caps 90 to align with a pair of tear-dropped shaped holes 58 provided in the bights 52 of the upright members 24.

In addition to the lugs 80, a retaining pin 100 is also attached to the bracket 32. The retaining pin 100 also extends through one of the apertures 74 in the face plate 72 of the bracket 68 between the lugs 80. The retaining pin 100 is attached to a spring clip 102 which is secured to the bracket 68 by the shaft 82 and nut 84 of one of the lugs 80. The spring clip 102 has a pair of wings 104 formed on it to facilitate axial movement of the retaining pin 100 to remove the retaining pin from the aperture 74. In use, when the bracket 68 is connected to the upright member 24 with the lugs 80 accommodated by the teardrop-shaped holes 58, the retaining pin 100 extends through the aperture 74 in the bracket 68 and is accommodated by one of the circular holes 56. Thus, the retaining pins 100 provide additional structural security to inhibit accidental separation of the bracket assemblies and upright members.

Figure 8B:
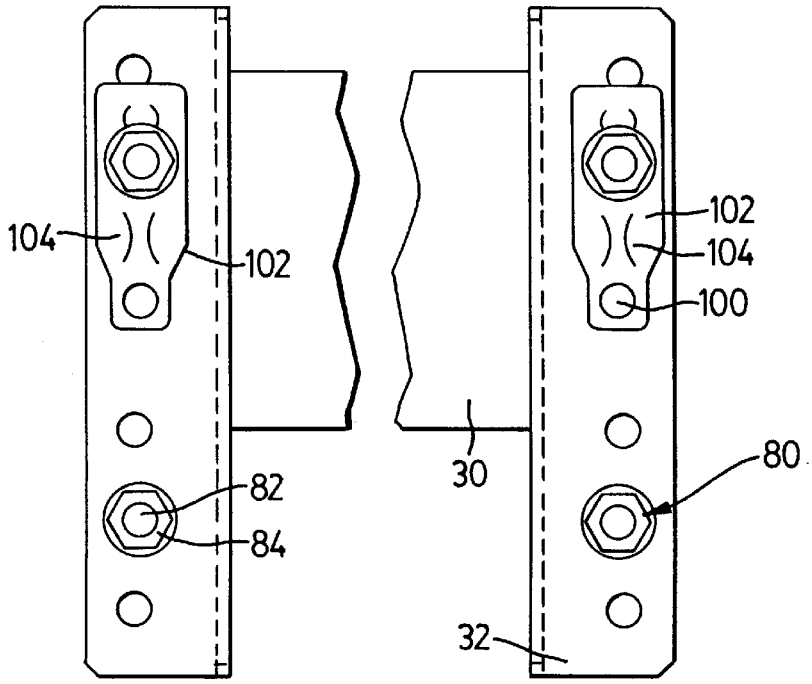
FIG. 8*b* is a front elevational view of a support beam and a pair of brackets with the lugs positioned for attachment of the brackets to a roll-form storage rack having uprights axial members with apertures therein arranged in a similar manner to those shown in FIG. 1.

FIG. 8*b* shows the lugs positioned on the brackets 68 in a manner to facilitate attachment of the brackets 68 and support beam 30 to a roll-form storage rack having apertures 56 and 58 formed in the upright axial members thereof arranged in a similar to those of FIG. 1. In this case, the shafts 82 of the lugs 80 and the retaining pin 100 pass through the apertures 76 in the face plate 72.

Prior to shipping the unassembled storage rack 20 to a site for assembly, the lugs 80 are attached to the brackets 68 in the proper manner depending on the type of storage rack and extend from the face plate 72 a distance which will accommodate the largest possible thickness of the upright member 24. The brackets 68 are welded to the support beams 30 so that the only assembly required at the site is to secure the brace members 26 to the upright members 24 and to connect the bracket assemblies 32 to the upright members 24.

The brace members 26 are secured to the upright members 24 at locations spaced from where the bracket assemblies 32 are to be attached to the upright members 24. This allows the brace members 26 to make use of the apertures in the upright members. When a support beam 30 is to be connected between a pair of upright members, the bracket 32 at each end of the support beam is positioned so that the lugs 80 are aligned with two of the teardrop-shaped holes 58. The brackets 68 are then moved towards the upright members 24 so that the lugs 80 pass through the larger diameter portions 58*a* of the teardrop-shaped holes 58. The support beam 30 is then released allowing the lugs 80 to self-plumb in the holes 58 and rest in the smaller diameter portions 58*b*. As the lugs self-plumb, the retaining pins 100 sit in the apertures 56. Once the brackets 68 are properly positioned, the nuts 84 can be tightened if necessary by hand or using a tool to adjust axially the lugs 80 and secure snugly the brackets 68 to the upright members 24. When the nuts 84 are tightened, the wedges 88 engage the face plates 72 to inhibit the lugs 84 from rotating as they are axially adjusted. If additional structural security is desired to inhibit accidental separation of the brackets and upright members, conventional storage rack bolts can be inserted through one or more of the other apertures 74 or 76 in the brackets 68 which are aligned with the circular holes 56.

Figure 10:
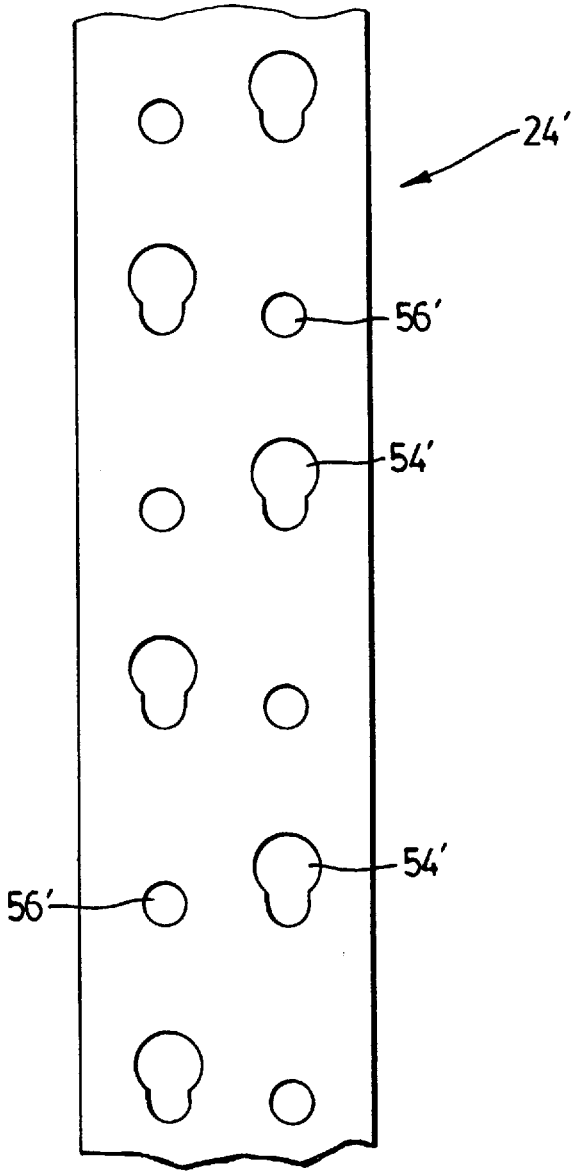
FIG. 10 is a front elevational view of an alternate embodiment of a C-channel member forming part of a storage rack in accordance with the present invention.
Figure 11A:
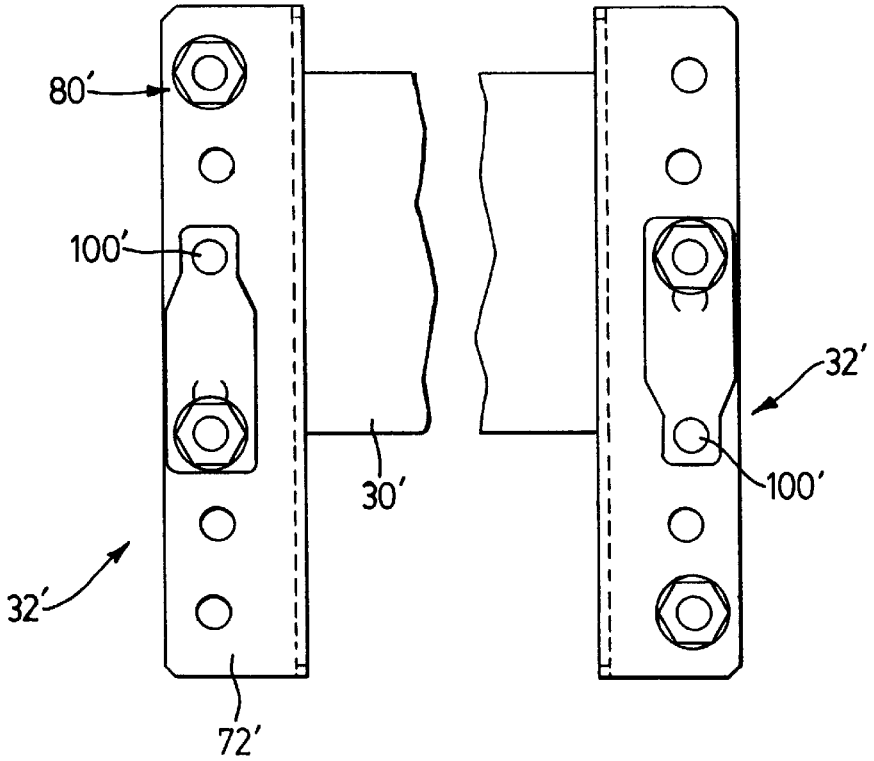
FIG. 11*a* is a front elevational view of a support beam and a pair of brackets with the lugs positioned for attachment of the brackets to a structural storage rack having C-channel members of the type shown in FIG. 10.
Figure 11B:
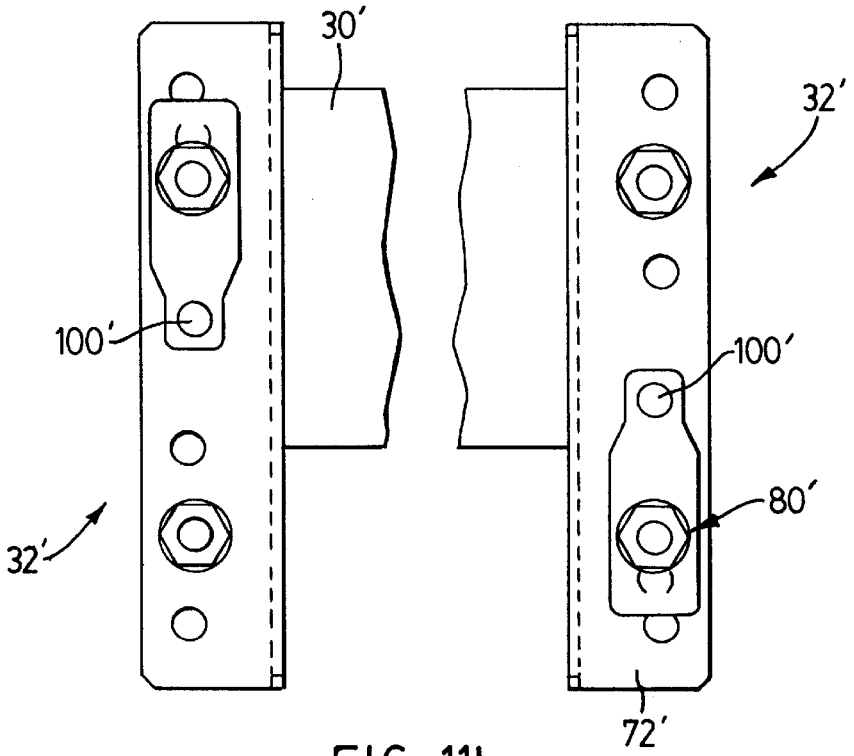
FIG. 11*b* is a front elevational view of a support team and a pair of brackets with the lugs positioned for attachment of the brackets to a roll-form storage rack having uprights axial members with apertures therein arranged in a similar manner to those shown in FIG. 10.

Referring now to FIG. 10, another embodiment of an upright member 24' is shown. In this embodiment, adjacent holes 56' and 58' respectively in the two columns of apertures 54' are different. FIG. 11*a* shows the proper positioning of the lugs 80' and retaining pins 100' on the face plates 72' of brackets 68' to facilitate attachment of the brackets and support beam 30' to a structural storage rack having apertures 56' and 58' therein which are oriented as shown in FIG. 10. FIG. 11*b* shows the positioning of the lugs 80' and retaining pins 100' on the face plates 72' of brackets 68' to facilitate attachment of the brackets and support beam 30' to a roll-form storage rack having apertures 56' and 58' therein which are oriented as shown in FIG. 10.

As one of skill in the art will appreciate, the present invention allows the storage rack to be assembled with relative ease while providing for secure connections between the brackets and the upright members. This is achieved by allowing the lugs to be axially adjusted to secure the connections between the brackets and the upright members. In addition, since the lugs are easily removable, the upright member and bracket designs are more versatile. Specifically, if desired, the lugs can be removed from the brackets allowing the brackets to be used with conventional structural storage racks. Since the brackets include lugs, the brackets may also be used with conventional roll-form storage racks. Also, since the brackets have two sets of apertures to accommodate the lugs and which are positioned to allow the lugs to be positioned for engagement either with a structural storage rack or a roll-form storage rack, the brackets are fully interchangeable.

Although the lugs have been described as being attached to the brackets, those of skill in the art will appreciate that the upright member may carry the lugs. In this case, the configuration of the apertures formed in the bracket will alternate between circular holes and teardrop-shaped holes. Also, although the lugs have been described as carrying the formations to inhibit rotation while the lugs are being axially adjusted, it should be appreciated that the face plate 72 may carry the formations about the periphery of the holes formed therein.

Those of skill in the art will also appreciate that other variations and modifications may be made to the present invention without departing from the scope thereof as defined by the appended claims.

I claim:

1. A storage rack to support pallets comprising:

an upright frame structure having a plurality of upright comer members, each of said upright members having vertically spaced primary holes formed in a face thereof;

a plurality of pairs of laterally spaced, generally parallel support beams at different elevations extending between pairs of said upright members; and a plurality of bracket assemblies, each of said bracket assemblies interconnecting an end of one of said support beams to one of said upright members, each of said bracket assemblies including an angle bracket having at least one axially adjustable projection thereon, said at least one projection including a plurality of circumferentially spaced wedges thereon to engage said angle bracket to inhibit rotation thereof when said at least one projection is axially adjusted, said at least one projection being accommodated by one of said primary holes, said primary holes being shaped so that said projections self-plumb to position properly said bracket assemblies with respect to said upright members thereby to interconnect said support beams and said upright members and resist axial movement of said support beams without requiring the use of tools, said upright members and said angle brackets further including supplementary secondary holes which align when said projections are accommodated by and fully engage with said primary holes, said secondary holes for receiving secondary retaining means providing a resistance to inadvertent disengagement of said projections from said primary holes as a result of upwardly directed forces presented on said support beams.

2. A storage rack comprising:

an upright frame structure having a plurality of upright corner members, each of said upright corner members having vertically spaced primary holes formed in a face thereof;

a plurality of pairs of laterally spaced support beams at different elevations extending between pairs of said upright members; and a plurality of bracket assemblies, each bracket assembly interconnecting an end of one of said support beams to one of said upright members, each of said bracket assemblies including an angle bracket having at least one axially adjustable projection thereon, said at least one projection including a plurality of circumferentially spaced wedges thereon to engage said angle bracket to inhibit rotation thereof when said at least one projection is axially adjusted, said at least one projection being accommodated by one of said primary holes, said primary holes being shaped so that said projections self-plumb to position properly said bracket assemblies with respect to said upright members thereby to interconnect said support beams and said upright members and resist axial movement of said support beams without requiring the use of tools.

3. A storage rack as defined in claim 2 wherein said at least one projection is in the form of a lug on said angle bracket.

4. A storage rack as defined in claim 3 wherein said upright members and said angle brackets further include supplementary secondary holes which align when said lugs are accommodated by and fully engage with said primary holes, said secondary holes for receiving secondary retaining means providing resistance to inadvertent disengagement of said lugs from said primary holes as a result of upwardly directed forces presented on said support beams.

5. A storage rack as defined in claim 4 wherein said secondary retaining means are in the form of retaining pins carried by said angle brackets.

6. A storage rack as defined in claim 5 wherein said retaining pins are attached to said angle brackets by resilient retainers.

7. A storage rack as defined in claim 6 wherein said resilient retainers are in the form of spring clips.

8. A storage rack as defined in claim 5 wherein said secondary retaining means are in the form of nuts and bolts.

9. A storage rack as defined in claim 3 wherein said angle brackets have at least two rows of generally circular apertures therein to accommodate said lugs, said apertures being positioned to allow said lugs to be accommodated by said primary holes on said upright members on either a structural storage rack or a roll-formed storage rack.

10. A storage rack as defined in claim 9 further comprising bracing members spanning pairs of said upright members on the same side of said storage rack, said bracing members being attached to said upright members at locations spaced from said bracket assemblies.

11. A storage rack as defined in claim 1 wherein said at least one projection on each angle bracket is in the form of a lug on said angle bracket.

12. A storage rack as defined in claim 1 wherein said secondary retaining means are in the form of retaining pins carried by said angle brackets.

13. A storage rack as defined in claim 12 wherein said retaining pins are attached to said angle brackets by resilient retainers.

14. A storage rack as defined in claim 11 wherein said angle brackets have at least two rows of generally circular apertures therein to accommodate said lugs, said apertures being positioned to allow said lugs to be accommodated by said primary holes on said upright members on either a structural rack or a roll-formed storage rack.

15. A storage rack as defined in claim 1 wherein each said at least one projection is removable from said angle bracket.

* * * * *

UNITED STATES PATENT AND TRADEMARK OFFICE

CERTIFICATE OF CORRECTION

PATENT NO. : 5,845,795

DATED : December 8, 1998

INVENTOR(S) : Anthony G. Mulholland

It is certified that error appears in the above-identified patent and that said Letters Patent is hereby corrected as shown below:

Claim 1, Col. 6, Line 3 delete "comer" and insert --corner--.

Signed and Sealed this

Twenty-seventh Day of April, 1999

*Attest:*

Q. TODD DICKINSON

*Attesting Officer*

*Acting Commissioner of Patents and Trademarks*